US005184890A

United States Patent [19]

Chen et al.

[11] Patent Number: 5,184,890

[45] Date of Patent: Feb. 9, 1993

[54] LAMP ASSEMBLY

[76] Inventors: Jen H. Chen, No. 15, Lane 167, Tung Nan Street; Jeou N. Tzeng, No. 52-1, Alley 100, Lane 311, Nan Yea Street; Jeng-Shyong Wu, Fl. 4, No. 5, Hsing Shyue Road, all of Hsin-Chu City, Taiwan

[21] Appl. No.: 639,686

[22] Filed: Jan. 10, 1991

[51] Int. Cl.[5] ..... F21V 11/00

[52] U.S. Cl. ..... 362/353; 362/226; 362/363; 362/396; 362/438

[58] Field of Search ..... 362/249, 246, 238, 351, 362/226, 353, 363, 437, 439, 438, 806, 396; 313/318

[56] References Cited

U.S. PATENT DOCUMENTS 4,667,276 5/1987 Cheng ..... 362/249

4,763,233 8/1988 Poyer ..... 362/363

5,012,397 4/1991 Tseng ..... 362/806 X

*Primary Examiner*—Stephen F. Husar

*Attorney, Agent, or Firm*—McGlew and Tuttle

[57] ABSTRACT

A lamp assembly, particularly used for a Christmas lamp string, having mainly a shade or shield at a first end, a hood with cover at a second end and an inter-connector joining in between the shield and the hood and serves to retain a lamp bulb with or without a socket. The socket is provided with self-contained conductor wires and fastening tab(s), single sided or double sided to be snap-locked by flap(s) disposed correspondingly on the inter-connector. When the inter-connector takes a bulb without socket, the bulb is inserted directly into the inter-connector where terminals of a pair of conductor wires are spacedly disposed to be electrically contacted with the blub base tightly inserted.

14 Claims, 5 Drawing Sheets

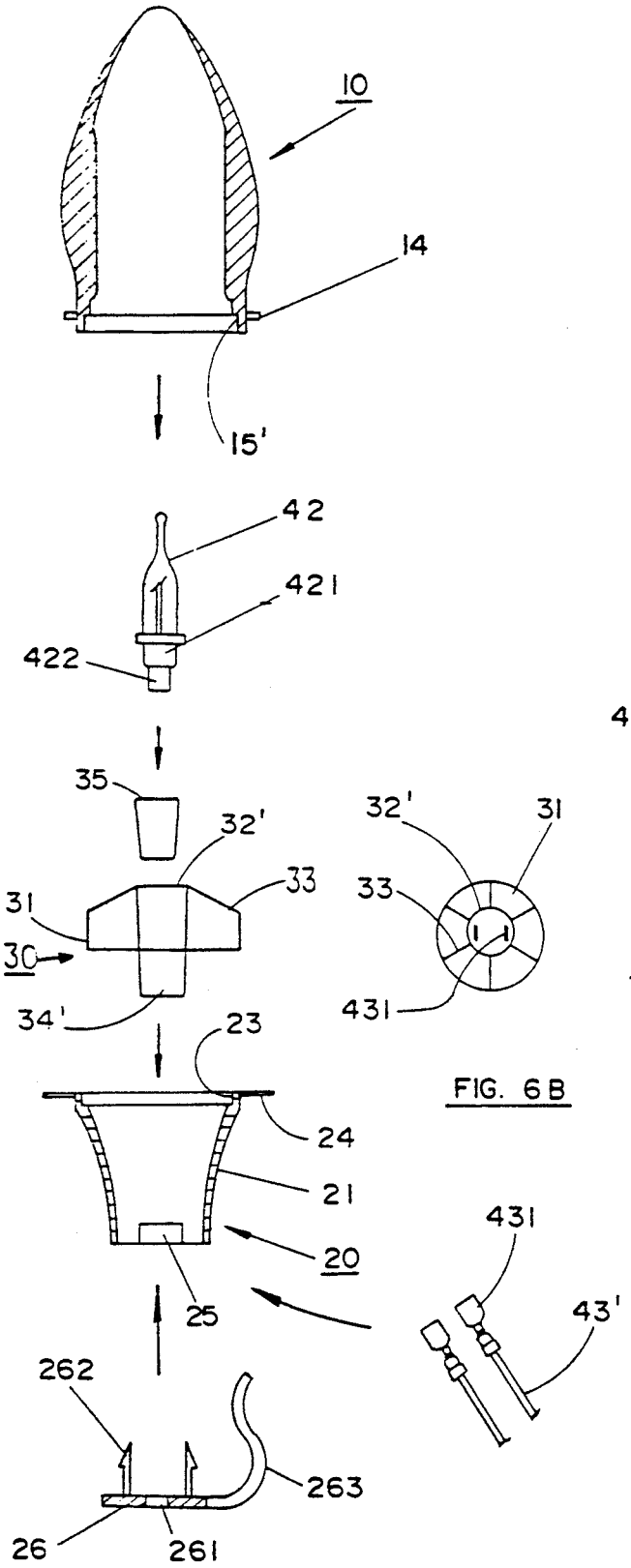
FIG. 6A
FIG. 6B
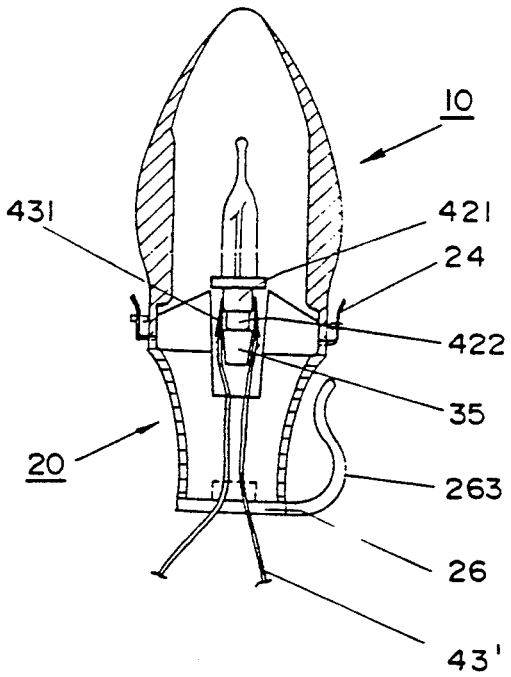
FIG. 5

LAMP ASSEMBLY

FIELD OF THE INVENTION

The present invention relates generally to a lamp assembly and more particularly to a lamp assembly used for a Christmas decoration lamp string. The invention has a lamp shield and a hood enveloping a lamp bulb. The lamp bulb having a pair of insulated lead wires to ensure steadiness, water-proofness and safety. An inter-connector joining in-between the shield and the hood serves as a retainer for a lamp bulb with or without a socket. The socket is provided with snap-locking means to be fastened to the inter-connector to further the steadiness. In the case of a socket not being used, means to tightly connect the lead wire terminal with the bulb is provided by the accommodation of a tapered connector wall and an insert spacer which is to be detailed later. Snap fastening means are provided between the shield and the hood to enhance the snap-grip of the two with the inter-connector nested there-between. This helps quick removal of the shield or hood independent from the assembly to effect the changing of bulb or maintenance of the wiring.

BACKGROUND OF THE INVENTION

A similar lamp assembly with shield and hood has been seen quite often in prior arts, such as disclosed in the U.S. Pat. No. 4,667,276 issued to Sam Cheng on May 19, 1987. A protective means, i.e. a hood is provided to cover the lamp socket and to connect with the lamp shield or shade, since the socket is directly involved in the hood. Maintenance of the assembly such as change the bulb, attending the wiring and so forth will become cumbersome. Besides, the connection between the shield and the hood is usually effected through insertion of the one into another, and liable to fall apart.

SUMMARY AND OBJECTS OF THE PRESENT INVENTION

Therefore the main object of the present invention is to facilitate easier servicing or maintenance of the inner parts in a lamp assembly by providing an inter-connector that is detachable from the shield and hood, and holding a lamp bulb with or without a socket so as to make the changing of the bulb and the attending of the wiring, independent from the shield and/or hood.

Another object of the present invention is to provide fastening means not only between the socket and the inter-connector but also between the shield and the hood to enhance a sure-grip of the two to better the protection.

A still further object of the present invention is a cover provided at the end of hood opening to facilitate the entering of a bulb and/or socket set, instead of provision of a whole piece hood.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is an elevational view of a third embodiment of the lamp assembly of the present invention, partially cut-away;

FIG. 6A is an exploded view of the lamp assembly of FIG. 5;

FIG. 6B is a top view of a further form of spider member used in the assembly of FIG. 5.

DETAILED DESCRIPTION OF THE PREFERRED EMBODIMENTS

Figure 2A:
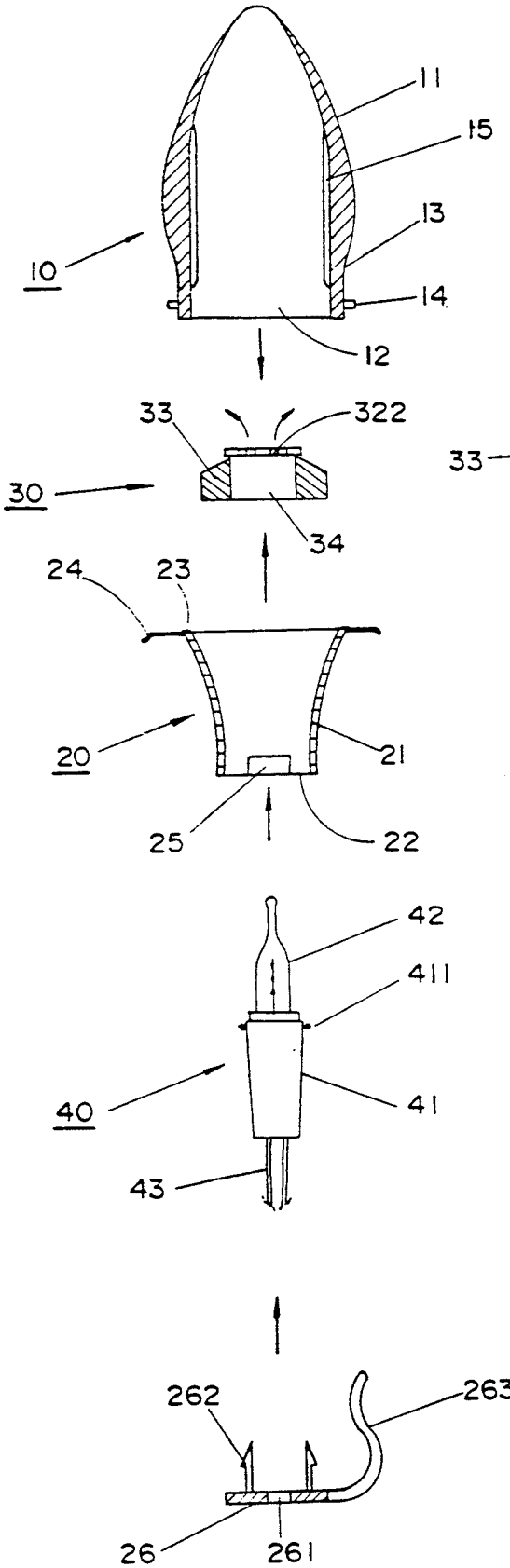
FIG. 2A is an exploded view of the lamp assembly of FIG. 1.
Figure 2B:
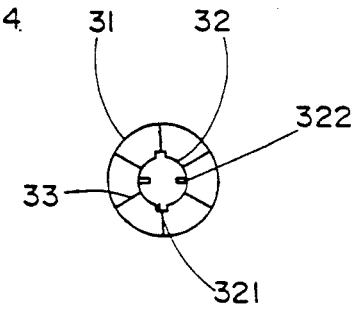
FIG. 2B is a top view of the related interconnector or spider member thereof.
Figure 1:
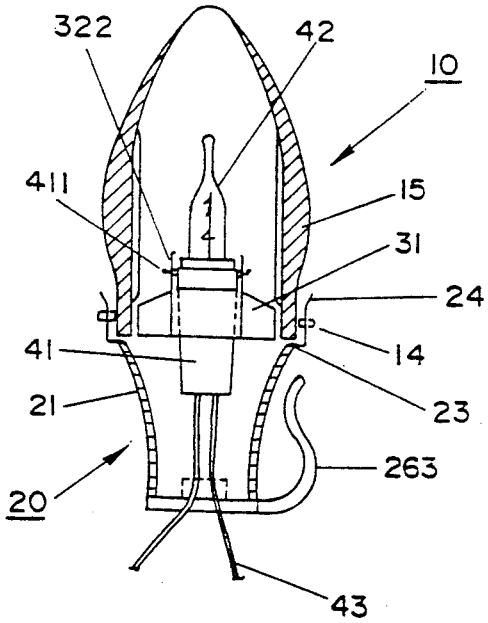
FIG. 1 is an elevational view of a first embodiment of the lamp assembly of the present invention, partially cutaway.

Now referring to the drawings and in particular to FIG. 1 and 2, the first embodiment of the lamp assembly of the present invention comprises a lamp shield or shade 10, a hood 20 with an inter-connector 30 (or referred to as a "spider" for short) connected there-between and a lamp proper 40 to be held in the spider.

The lamp shield 10 has a shell 11 with a bottom opening 12; a neck 13 with an abutment 15 located adjacent to the opening 12 for taking and securing the spider member 30 which is to be detailed later.

A pair of shield fastening tabs 14 are diametrically disposed outside the neck 13 for fastening of the shield 10 to hood 20, the hood 20 has a body 21 which flares at top forming a circular shouldered rim 23 to receivingly rest the lower end of said inter-connector or spider member 30. Extended from the flared top rim 23 of the hood body 21, a pair of foldable flaps 24, having slot on each, is provided diametrically to the top rim 23 for catching the shield fastening tabs 14 on the shield and locking up the same when its lower opening 12 is rested on the shoulder 23. The hood may be formed with resilient plastic material so that the extended flap 24 thereof can be folded up to erect or folded down flat without being broken, otherwise the flap can be made separately to be hinged to the upper rim of the hood 20 to fulfill the requirement as mentioned. lower end of the hood body 21. The opening 22 facilitates the handling of a bulb 42 therethrough. The port 25 is for the outlet of the self-contained lead connector wires 43 of the socket 41 of which the upper edge is provided with at least two fastening tabs 411 which may be disposed in diametrically opposite pair(s) as in this embodiment to be fastened to the spider 30. To the lower opening 22 of the hood body 21, a cover 26 having vent hole 261 and a pair of catching spurs to facilitate tight attachment inside the hood body 21 is optionally provided thereon. The cover 26 is further provided with a hook 263 for hanging the lamp assembly anywhere as desired such as on a bough of a Christmas tree.

Now the inter-connector or the spider is to be detailed. The inter-connector comprises an outer circular wall 31 of a relatively lesser height and an inner circular wall 32 of a greater height and a plurality of spoke partitions 33 joining there-between, each spoke partition 33 is actually outwardly declined on top. The inner wall 32 has radial recess(es) 321 provided to facilitate passing of fastening means 411 disposed at the socket side(s). The inner wall further includes locking flap(s) 322 to be lifted up to fasten and couple with the fastening means 411 disposed double sided on the socket 41. The design of the fastening means 411 may be of the "in-pair" tab type and in double decks, i.e. two pieces at a side, and therefore two slots shall have to be provided with on each flap 322 correspondingly. However, said variations are not shown in the drawing. Having seated on the shoulder 23 of the hood body 21 with its bottom, the spider 30 is abutted on top by the abutment 15 of the shield shell 11 so that the spider 30 is held tightly there-in-between. The flap(s) 24 extended from the shoulder 23 may then be folded upright to catch the shield fastening tab(s) 14 to lock the whole lamp assembly up.

Figure 4:
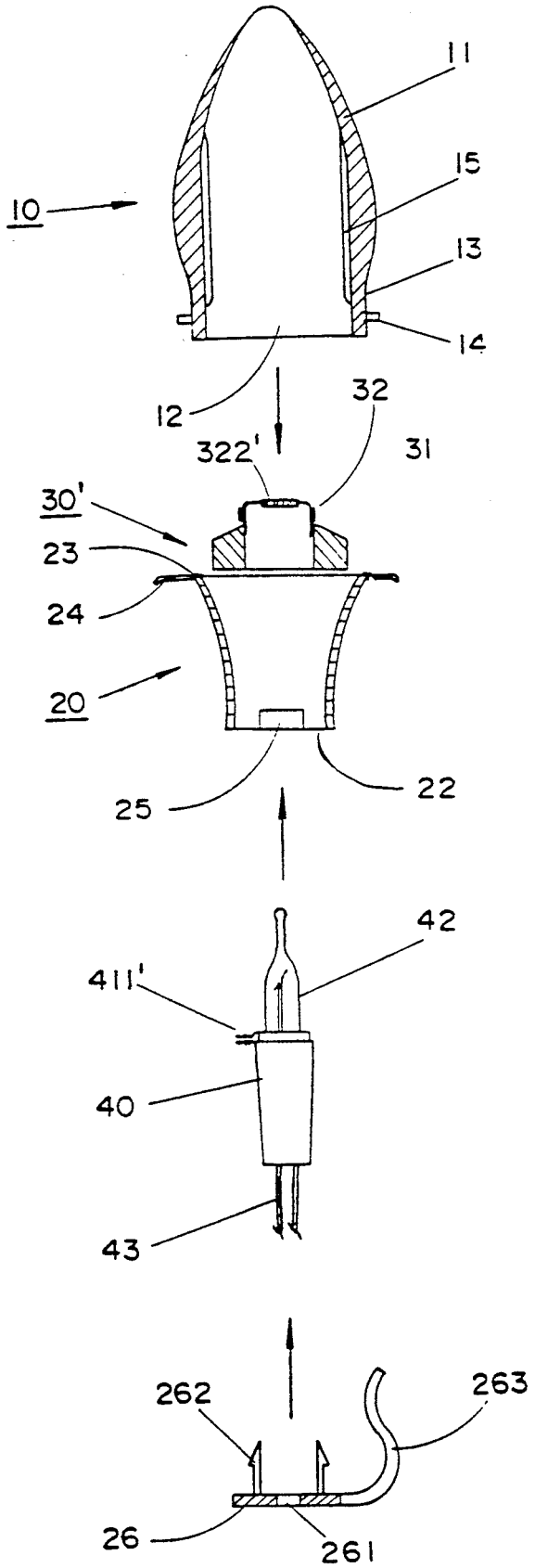
FIG. 4 is an exploded view of the lamp assembly of FIG. 3.
Figure 3:
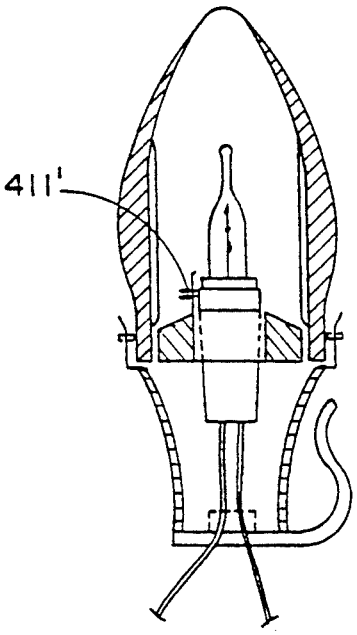
FIG. 3 is an elevational view of a second embodiment of the lamp assembly of the present invention, partially cut-away.
Figure 8:
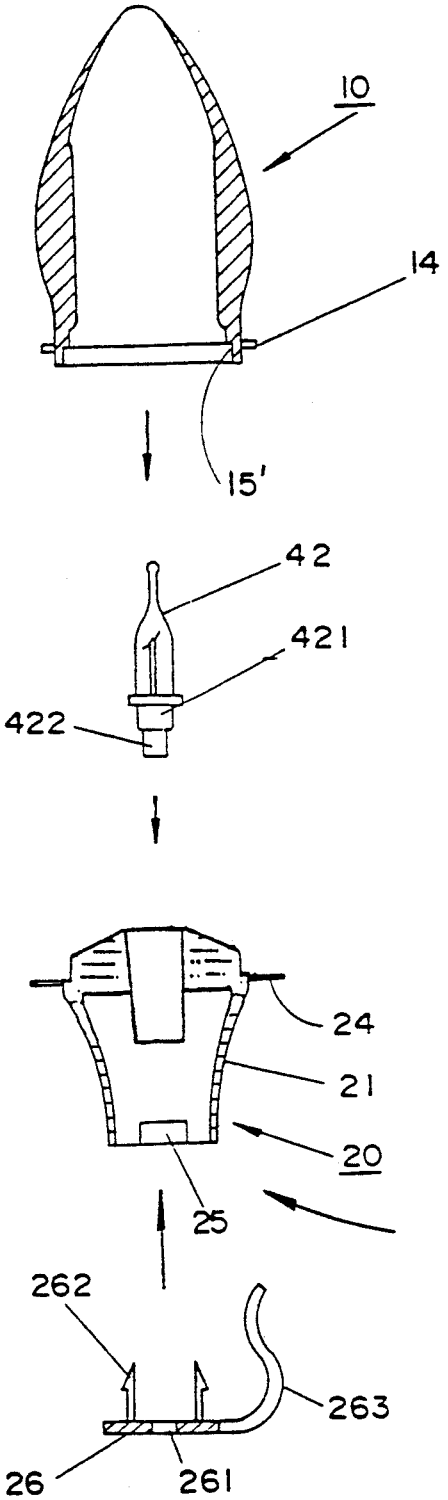
FIG. 8 is an exploded view of the lamp assembly of FIG. 7.

Referring next to FIGS. 3 and 4 for a second embodiment of the lamp assembly of the present invention. All the parts that are similar to those in the first embodiment are marked with same numerals.

In this embodiment two tabs 411' are disposed and are single sided. Only one locking flap 322' is provided in the center of the spider 30' to be coupled with tab 411'. The tabs 411' may present in a number more than two, say three, single sided yet in triple decks (not shown) instead of double-decked. Locking flap 322' shall have to provide with three slots to cope with the triple tabs. The remainder of parts is just the same as in FIG. 1 and 2 of the first embodiment with one exception that an abutment 15' is built-in other than the one 15 in the first embodiment.

In FIGS. 5 and 6, it can be clearly seen that the third embodiment thereof is a type without a socket, wherein the lamp bulb 42 with contacts 422 on base 421 is inserted directly into the spider center surrounded by inner wall 32' which is elongated and tapered to form a bottom opening 34'. A pair of conductor wires 43' each with terminals 431 thereon are led in through port 25 of the hood, entering the bottom opening 34' of the spider and held diametrically opposite against the inner wall 32'. A terminal spacer 35 of the shape of a plug is inserted from atop to squeeze tight the conductor wires so that the bulb base 421 may have its contacts 422 held steadily between the terminals 431.

The components in FIG. 6A, including the spider 30 and the hood 20 with cover (even with the shade 10 if necessary) could be integrally injection-molded.

Figure 7:
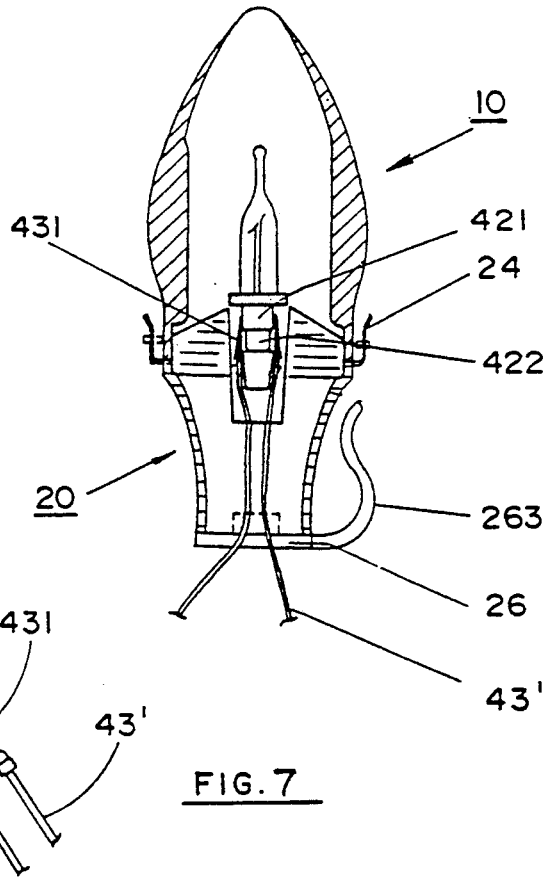
FIG. 7 is an elevation view of another embodiment of the lamp assembly of the present invention with an integral molded inter-connector and hood assembly with a lamp bulb that can be used without a lamp proper.
Figure 10:
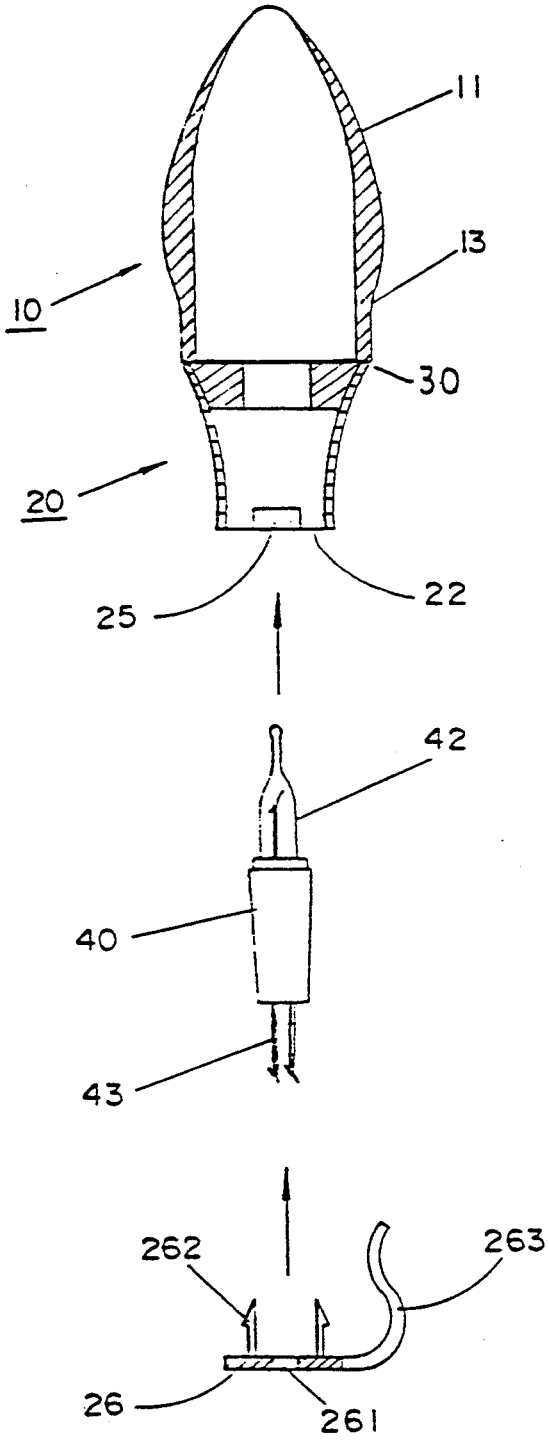
FIG. 10 is an exploded view of the lamp assembly of FIG. 11.
Figure 9:
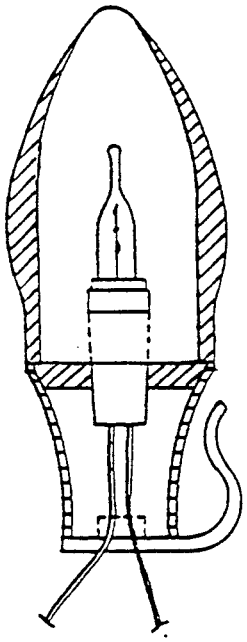
FIG. 9 is an elevation view of further another embodiment of the lamp assembly of the present invention with an integral molded inter-connector, hood and shade assembly.

FIG. 7 and 9 show an embodiment with the inter-connector 30 integrally molded with the hood 20 but the lamp bulb 42 does not have a socket 41. FIGS. 9 and 10 show the embodiment where the inter-connector 30, the hood 20 and the shield 10 are all formed integrally in one piece by injection molding as described above in reference to the components of FIG. 6A.

The spiders in each embodiment can also have its spaces in between the spokes nullified, in other words, the whole thing becomes a seal-typed one to enhance its mechanical strength.

A list of components is attached hereunder for easy reference.

The invention is described through embodiments which depict the features of the lamp assembly of the present invention but not served as limitation.

Those skilled in the art may modify and change without departure from the spirit of the invention, of which the scope of the attached claims is to cover.

LIST OF COMPONENTS

10 Lamp shield (or shade)
11 shell
12 opening
13 neck
14 fastening tab, shade
15 abutment
15' abutment, built in
20 Hood
21 body
22 opening
23 shouldered rim
24 locking flap (for shade)
25 port
26 cover
  261 vent
  262 catching spur
  263 hook
30(30') inter-connector (spider)
31 outer circular wall
32 inner circular wall
  321 radial recess
  322 locking flap (for lamp socket), double sided
  322' locking flap (for lamp socket), single sided
32' inner circular wall (tapered)
33 spoke partition
34 opening, spider bottom
34' opening, spider bottom (extended)
35 terminals spacer
40 lamp proper
41 lamp socket
  411 fastening tab, lamp socket, double sided
  411' fastening tab, lamp socket, single sided
42 lamp bulb
  421 bulb base
  422 contacts
43 conductor wire
431 conductor terminal

We claim:

1. A lamp assembly comprising:
a shield;
a hood supporting said shield;
an inter-connector positioned inside said shield and supported by said hood, said inter-connector having an outer wall and an inner wall, and a plurality of spoke partitions joining said inner wall to said outer wall;
a lamp bulb positioned in said inter-connector; and
a pair of conductor wires passing through said hood and connecting to said lamp bulb.

2. A lamp assembly in accordance with claim 1, wherein:
said inner wall is tapered downward;

said pair of conductor wires lead to said inner wall and terminate with respective terminals; and said inner wall contains a terminal spacer plug pressing said terminals tightly against said inner wall and said lamp bulb.

3. A lamp assembly in accordance with claim 1, wherein:

spaces between said plurality of spoke partitions are filled and said inter-connector becomes wholly sealed.

4. A lamp assembly in accordance with claim 1, wherein:

said hood and said inter-connector are formed in one integral piece by a mold-injection process.

5. A lamp assembly in accordance with claim 1, wherein:

said hood, said inter-connector and said shield are formed in one integral piece by a mold-injection process.

6. A lamp assembly in accordance with claim 1, wherein:

said inner wall of said inter-connector has a height greater than said outer wall, each of said plurality of spoke partitions is outwardly declined on a top side, said lamp bulb has a fastening tab positioned on a side of said lamp bulb, said inner wall defines a radial recess for passage of said fastening tab of said lamp bulb, and said inner wall having a locking flap means for locking with said fastening tab.

7. A lamp assembly in accordance with claim 6, further comprising:

another fastening tab on said lamp bulb, said another fastening tab being positioned substantially diametrically opposite said fastening tab: and another locking flap means for locking with said another fastening tab, said another locking flap means being positioned on said inner wall substantially diametrically opposite said locking flap means.

8. A lamp assembly in accordance with claim 6, further comprising:

a plurality of additional fastening tabs on said lamp bulb, said plurality of additional fastening tabs being positioned adjacent said fastening tab, said locking means having a number of slots equal to a number of additional fastening tabs plus said fastening tab.

9. A lamp assembly in accordance with claim 8, further comprising:

another plurality of additional fastening tabs on said lamp bulb, said another plurality of additional fastening tabs being positioned substantially diametrically opposite said plurality of additional fastening tabs;

another locking flap means for locking with said another plurality of additional fastening tabs.

10. A lamp assembly in accordance with claim 1, wherein:

said shield has a neck portion, a pair of shield fastening tabs on said neck portion are positioned substantially diametrically opposite each other, a circular button inside said shield is in contact with said outer wall when said shield is assembled with said hood.

11. A lamp assembly in accordance with claim 10, wherein:

said hood has a flared end with a shoulder for supporting said inter-connector, said hood having hood locking means for connecting with said shield fastening tabs, said hood defining a port for said passing through of said pair of conductor wires.

12. A lamp assembly in accordance with claim 11, further comprising:

a cover connected to a bottom of said hood, said cover having catching spur means for connecting to said hood, said cover also having a hook means for hanging the lamp assembly.

13. A lamp assembly in accordance with claim 12, wherein:

said cover defines a vent.

14. A lamp assembly in accordance with claim 1, wherein:

spaces between said plurality of spoke partitions are nullified and said inter-connector becomes wholly sealed.

* * * * *